US007356157B2

(12) United States Patent
Proni

(10) Patent No.: US 7,356,157 B2
(45) Date of Patent: Apr. 8, 2008

(54) LOUDSPEAKER LEAD WIRE MANAGEMENT SYSTEM

(75) Inventor: Lucio Proni, Weston, FL (US)

(73) Assignee: JL Audio, Inc., Miramar, FL (US)

( * ) Notice: Subject to any disclaimer, the term of this patent is extended or adjusted under 35 U.S.C. 154(b) by 512 days.

(21) Appl. No.: 11/018,442

(22) Filed: Dec. 21, 2004

(65) Prior Publication Data

US 2006/0133640 A1 Jun. 22, 2006

(51) Int. Cl.
*H04R 1/02* (2006.01)

(52) U.S. Cl. ..... 381/395; 381/394

(58) Field of Classification Search ..... 381/394, 381/395, 396, 407, 409
See application file for complete search history.

(56) References Cited

U.S. PATENT DOCUMENTS 2,037,811 A * 4/1936 Lee et al. ..... 381/409

* cited by examiner

*Primary Examiner*—Brian Ensey
(74) *Attorney, Agent, or Firm*—Gray Robinson, PA

(57) ABSTRACT

This invention is directed to a loudspeaker having a lead wire management system including guides located at both the voice coil and the frame of the speaker. Each guide is angled allowing them to control the arc at which the lead wires extend between the voice coil and frame, and rounded edges of the guides relieve stress on the lead wire joint connections during motion of the voice coil.

21 Claims, 14 Drawing Sheets

36
20
10
16
40
38
50
44
54

52
38
40
14
36
18
58
34
58
62
42
32
60
22
26
12
27
24
28
30

52
70
54
64
74
76
68
18
78

LOUDSPEAKER LEAD WIRE MANAGEMENT SYSTEM

FIELD OF THE INVENTION

This invention relates to loudspeakers, and, more particularly, to a loudspeaker lead wire management system in which the lead wires connected between the voice coil and frame are relatively easy to install and of the proper length and arc to avoid stress on their joint connections and to prevent contact with the diaphragm, spider and other elements during speaker operation.

BACKGROUND OF THE INVENTION

Loudspeakers generally comprise a frame, a motor structure, a diaphragm, a lower suspension or spider and a surround or upper suspension. In one type of speaker, the motor structure includes a permanent magnet sandwiched between a top plate and a back plate, with a pole piece centrally mounted on the back plate so that both the top plate and magnet are concentrically disposed about the pole piece. A magnetic gap is formed between the pole piece and top plate within which a voice coil is axially movable. The voice coil consists of a hollow, cylindrical-shaped former including an inner surface and an outer surface which mounts a winding of wire having a voice coil lead. Lead wires are connected at one end to the voice coil lead of the wire winding, and at their other end to electrical terminals which are fixed to the frame. The voice coil is mounted within the magnetic gap by the upper and lower suspensions and the diaphragm. One end of the diaphragm is connected to the upper suspension, which, in turn, is mounted to the upper end of the frame. The lower suspension or spider is connected at one end to a seat or spider plateau formed in the frame. The free ends of the diaphragm and spider are mounted to the outer surface of the former of the voice coil and support it for axial movement within the magnetic gap. In the course of operation, electrical energy is supplied via the lead wires to the voice coil causing it to axially move within the magnetic gap. The voice coil, diaphragm, upper suspension and spider collectively form a "moving assembly" which reciprocates as a unit with the excursion of the voice coil.

Loudspeakers of the type described above are typically manufactured as follows. The motor structure is assembled by gluing the magnet in between the top plate and back plate, and then the frame and motor structure are connected together. Using precision shim stock positioned between the voice coil former and pole piece, the voice coil is located within the motor structure at the appropriate height. In most instances, one end of each lead wire is attached to the voice coil lead of the wire winding of the voice coil before it is placed in position relative to the pole piece.

As noted above, the voice coil is suspended within the magnetic gap of the motor structure by the upper suspension or surround and the spider. First, the inner diameter of the spider is slid down over the former of the voice coil to a height which allows its outer diameter to lay flat on the spider plateau formed in the frame. The inner diameter of the spider is then glued to the voice coil former and its outer diameter is glued to the spider plateau. With the spider in position, the body of the diaphragm is slid over the voice coil former. In most instances, the diaphragm and surround are supplied by the manufacturer as a single, interconnected unit. Typically, a foot or flange of the diaphragm rests on the joint connection between the spider and the voice coil so that the diaphragm is placed at the appropriate height relative to the voice coil. The diaphragm is glued to the voice coil, and the surround is glued to a flange at the top of the frame. The lead wires are then threaded through holes in the diaphragm and extended toward the frame. A dust cap is often attached to the diaphragm, over its open center, to prevent dust and other debris from entering the voice coil or motor structure. Finally, the free end of each lead wire is attached to the electrical terminals on the frame, which are usually attached to the frame in a prior assembly operation.

Once the voice coil is positioned on the pole piece of the motor structure, all other assembly operations noted above must be performed within the loudspeaker frame because fixtures are employed to obtain proper alignment of the remaining parts. Depending upon the physical size of the loudspeaker being assembled, it is difficult to fit one's hands into the loudspeaker frame to work. Although many frames are formed with openings or "windows," these openings are usually of limited size particularly in small speakers. This constraint can make installing the lead wires a real challenge, and it is extremely difficult to accurately gauge the length of the lead wires within the frame.

Several problems arise if the lead wires are not properly installed in a speaker. If a lead wire is too short, it can be drawn too tight during high excursions of the voice coil risking damage to the moving assembly and the lead wire connections. On the other hand, lead wires which are too long create a large arc between the voice coil and electrical connections at the frame. Long lead wires can dynamically misbehave during diaphragm movement, potentially contacting the diaphragm or spider, and create undesirable noise. Further, not unlike a guitar string, the suspended length of the lead wire can have its own resonance behavior. Consequently, if the length of the lead wire is not carefully considered during the design phase of the speaker and then properly installed, a loudspeaker can be rendered nearly useless by the undesirable noises created.

There have been attempts in the prior art to manage the dynamic behavior of speaker lead wires. At the frame, lead wires are very often soldered to electrical terminals with a small amount of flexible glue being applied at the location where the lead wire leaves the terminal. The purpose of the flexible glue is to attempt to control the angle at which the lead wire exits the terminal, to provide at least some motion damping and to relieve stress at the connection of the lead wire to the terminal. At the other end of the lead wires, flexible glue is typically used where the lead wires extend through holes in the diaphragm in an attempt to control the angle of the lead wire at that location and also to assist with management of the dynamic behavior of the lead wire, including stress relief at the lead wire connection to the voice coil. Unfortunately, applying flexible glue consistently at either end of the lead wires is very difficult since these operations must be performed by hand within the interior of the speaker frame.

SUMMARY OF THE INVENTION

This invention is directed to a loudspeaker having a lead wire management system including guides located at both the voice coil and the frame of the speaker. Each guide is angled allowing them to control the arc at which the lead wires extend between the voice coil and frame, and rounded edges of the guides relieve stress on the lead wire connections during motion of the voice coil.

In one presently preferred embodiment, a voice coil bracket is mounted to the voice coil having an integral guide in the form of a bore which is angled in a direction toward the frame and has a smooth outlet edge. A frame bracket is mounted to the frame and it is formed with the same guide construction as the voice coil bracket except with one or more bores angled toward the voice coil. The guide in each bracket receives and supports one lead wire which is connected at one end to the voice coil lead and at the opposite end to an electrical connector secured to the frame. The angles of the guides in the two brackets are chosen to control the arc at which the lead wires extend between the voice coil and frame. The arc of the lead wires must be such that they do not contact the diaphragm, or the spider, during excursion of the voice coil. The brackets employed in this invention provide for precise control of the lead wire arc and length which ensures that the dynamic behavior of the lead wires is properly managed. Additionally, the smooth outlet edge of the bores forming the guides in each bracket is effective to reduce stress or pulling on the lead wire connections particularly during high excursions of the voice coil.

The voice coil bracket and frame bracket of this invention eliminate the need for flexible glue used in the prior art to attempt to manage the dynamic behavior of the lead wire, and allows the lead wires to be mounted to the voice coil outside of the frame. Unlike the prior art, the lead wires need not be threaded through holes in the diaphragm during assembly of the speaker which simplifies the manufacturing process.

In some embodiments of this invention, the voice coil bracket is formed with an upper seat to receive and mount the lower end of the diaphragm, and a lower seat which mounts the inner diameter of the spider. Alternatively, the diaphragm and/or the spider may be mounted directly to the voice coil. Using fixtures to obtain proper alignment and vertical spacing, either construction allows the spider to be mounted to the voice coil bracket and to the frame bracket outside of the frame. Preferably, the lead wires are attached to the wire winding and voice coil bracket at one end, and to the frame bracket at the opposite end, outside of the frame as well. The spider, voice coil and frame bracket are inserted into the speaker frame as a unit by sliding the voice coil over the pole piece of the motor structure, and then gluing the foot of the frame bracket to a plateau formed in the frame. The end of the lead wires carried by the frame bracket may then be connected to electrical terminals mounted to the frame or integrated with the frame bracket.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE PREFERRED EMBODIMENTS

Figures 1, 2:
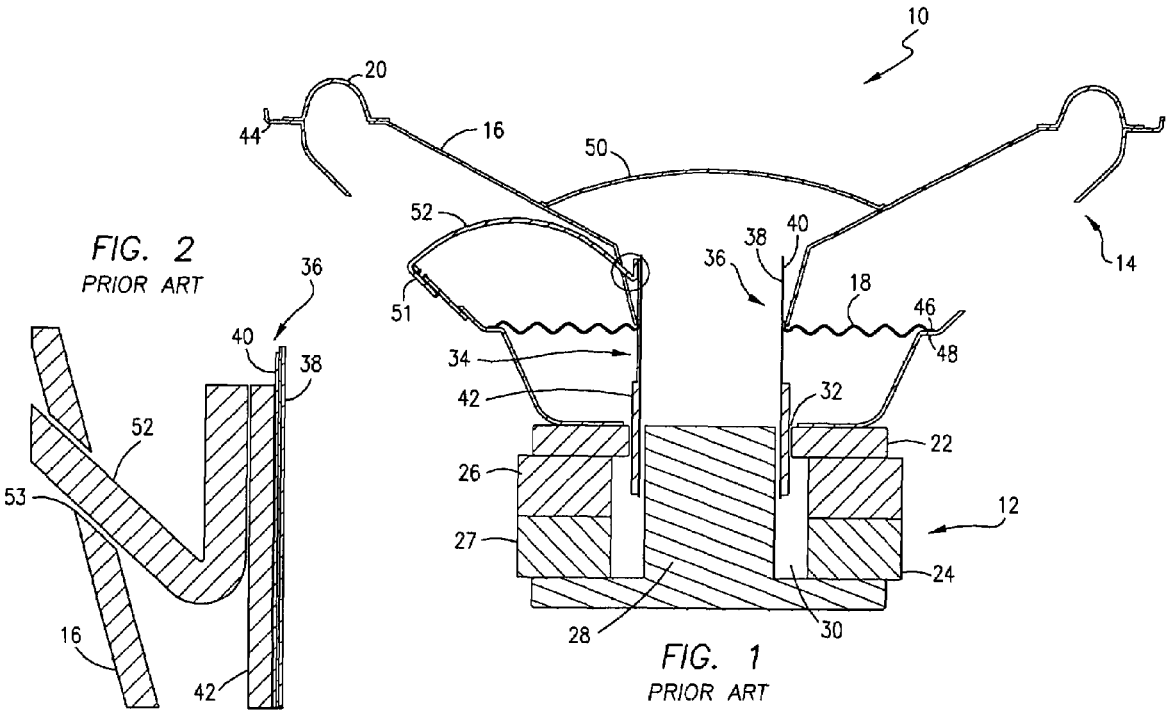
FIG. 2 PRIOR ART
FIG. 1 PRIOR ART
FIG. 1 is a cross sectional view of a prior art loudspeaker which includes holes formed in the diaphragm to receive lead wires which are then mounted to an electrical connector on the speaker frame.
FIG. 2 is an enlarged view of the encircled portion of FIG. 1 showing a lead wire extending through the diaphragm.
Figure 3:
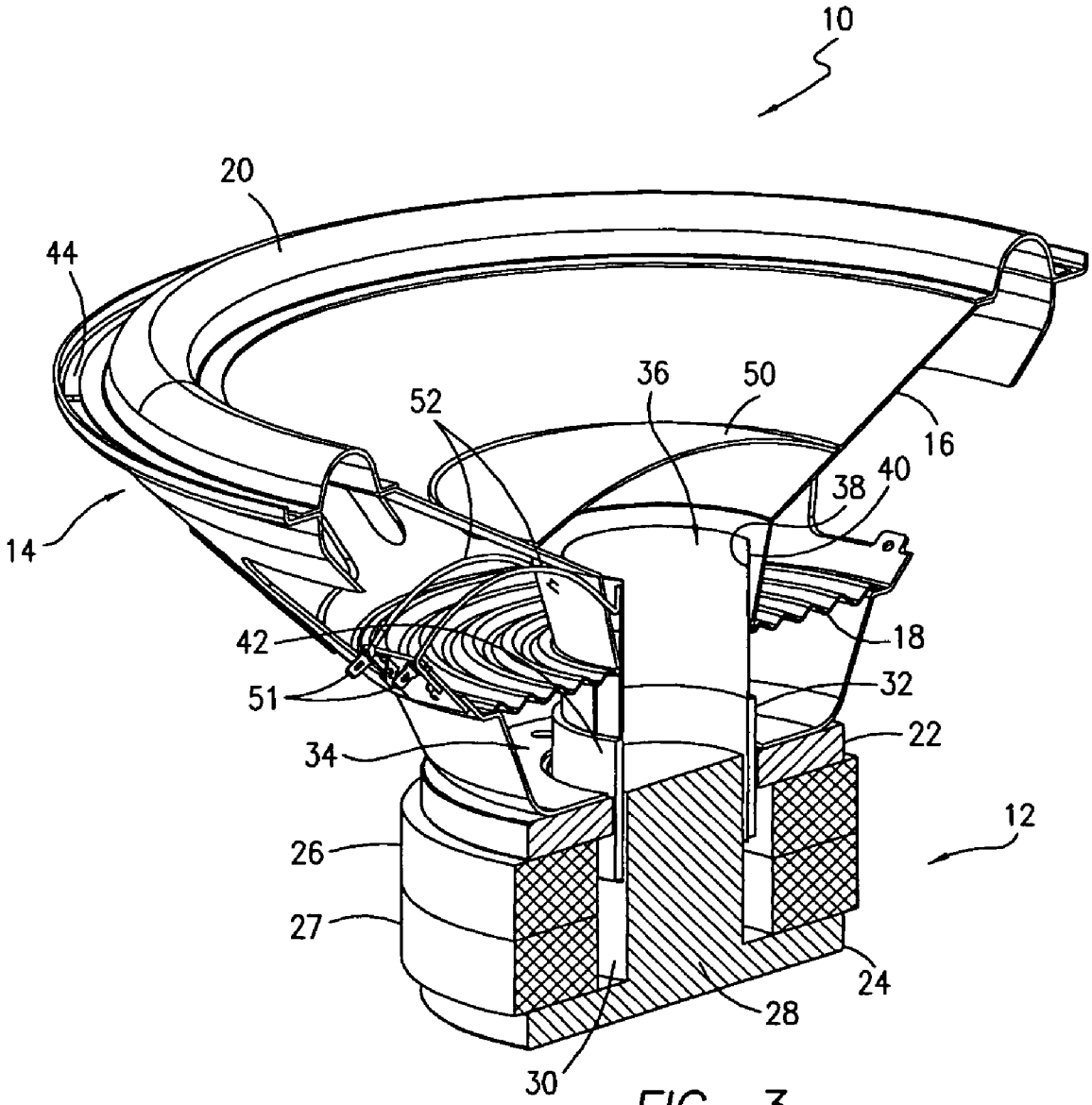
FIG. 3 PRIOR ART
FIG. 3 is an isometric cross section of the speaker shown in FIG. 1.

Referring initially to FIGS. 1 through 3, a loudspeaker 10 is illustrated which includes a standard, prior art connection of the lead wires to the voice coil and frame, as described below. The speaker 10 generally comprises a motor structure 12, a frame 14 mounted to the motor structure 12, a diaphragm 16, a lower suspension or spider 18 and an upper suspension or surround 20. Conventionally, the motor structure 12 includes a top plate 22 and a back plate 24 which are spaced from one another and mount a pair of permanent magnets 26 and 27 between them. A pole piece 28 is integrally formed with and extends upwardly from the back plate 24 into a central bore 30 formed in both magnets 26, 27 and the top plate 22. A magnetic gap 32 is formed between the top plate 22 and the pole piece 28. A voice coil 34 is also provided which includes a hollow, cylindrical-shaped former 36 having an inner surface 38 and an outer surface 40 which mounts a wire winding 42. The former 36 is concentrically disposed about the pole piece 28, and the voice coil 34 is axially movable within the magnetic gap 32 during operation of the speaker 10.

The voice coil 34 is held in place with respect to the pole piece 28 by the diaphragm 16, spider 18 and surround 20. In the prior art speaker 10 shown in FIGS. 1-3, the inner diameter of the diaphragm 16 is affixed to the former 36 by adhesive or the like, and its outer diameter connects to the surround 20. The surround 20, in turn, is mounted to the upper end 44 of the frame 14 as shown. The spider 18 is connected to the outer surface 40 of the former 36 along its inner diameter, and a foot 46 formed at the outer diameter of the spider 18 is glued directly to a seat or spider plateau 48 formed in the frame 14.

A dust cap 50 is mounted to the diaphragm 16 in position to overlie the voice coil 34 and pole piece 28 in order to protect such elements from dirt, dust and other contaminants. A dust cap cavity is therefore formed in the area defined by the lower portion of the diaphragm 16, the dust cap 50, the voice coil 34 and the pole piece 28.

As noted above, each lead wire 52 of the speaker 10 is mounted at one end to the wire winding 42 and at the other end to an electrical terminal 51 connected to the frame 14. Each lead wire 52 is extended through a bore 53 formed in the diaphragm 16. In response to the input of electrical energy to the wire winding 42, the voice coil 34 is moved axially with respect to the fixed motor structure 12. Because the diaphragm 16, spider 18, surround 20 and dust cap 50 are operatively connected to the voice coil 32, such elements also move with the excursion of the voice coil 32 thus collectively forming a moving assembly.

Referring now to FIGS. 4 through 21, the loudspeaker 10 is depicted with alternative embodiments of a novel means of mounting lead wires 52 to the voice coil 34 and to the frame 14 according to this invention. Each embodiment is described separately below with reference to specific Figs., it being understood that structure of the loudspeaker 10 common to each embodiment, and to the prior art speaker shown in FIGS. 1 to 3, is given the same reference numbers throughout. For purposes of the present discussion, the terms "upper," "lower," "above," "below," "top" and "bottom" refer to spatial orientations with the speaker 10 positioned as it is shown in the Figs.

Figure 5:
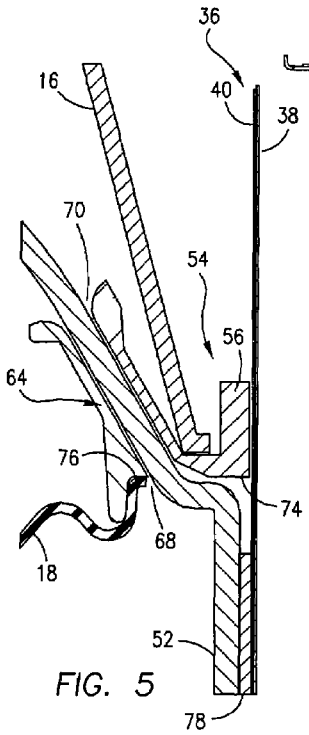
FIG. 5 is an enlarged view of the encircled portion of FIG. 4.
Figure 4:
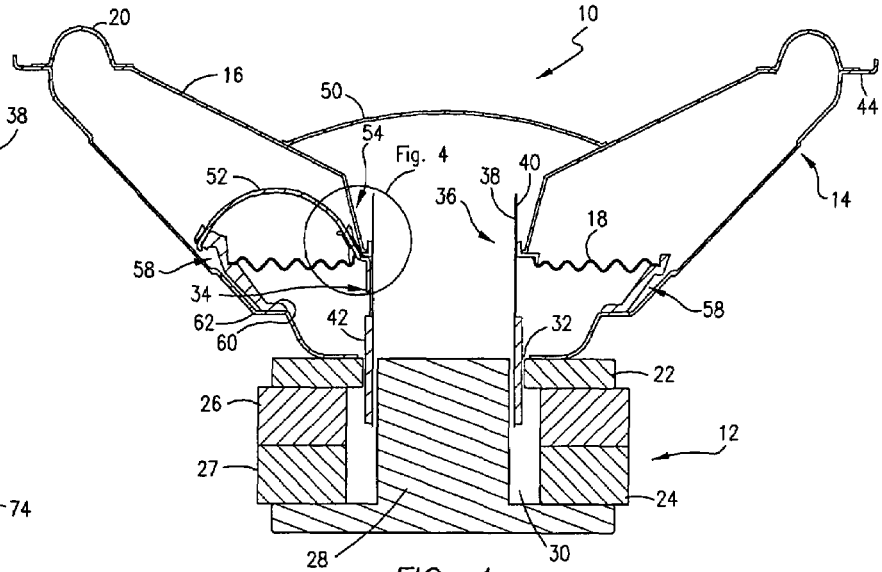
FIG. 4 is a view similar to FIG. 1 but depicting a speaker having the voice coil bracket and frame bracket of this invention with the lead wires connected below the voice coil bracket.
Figure 6:
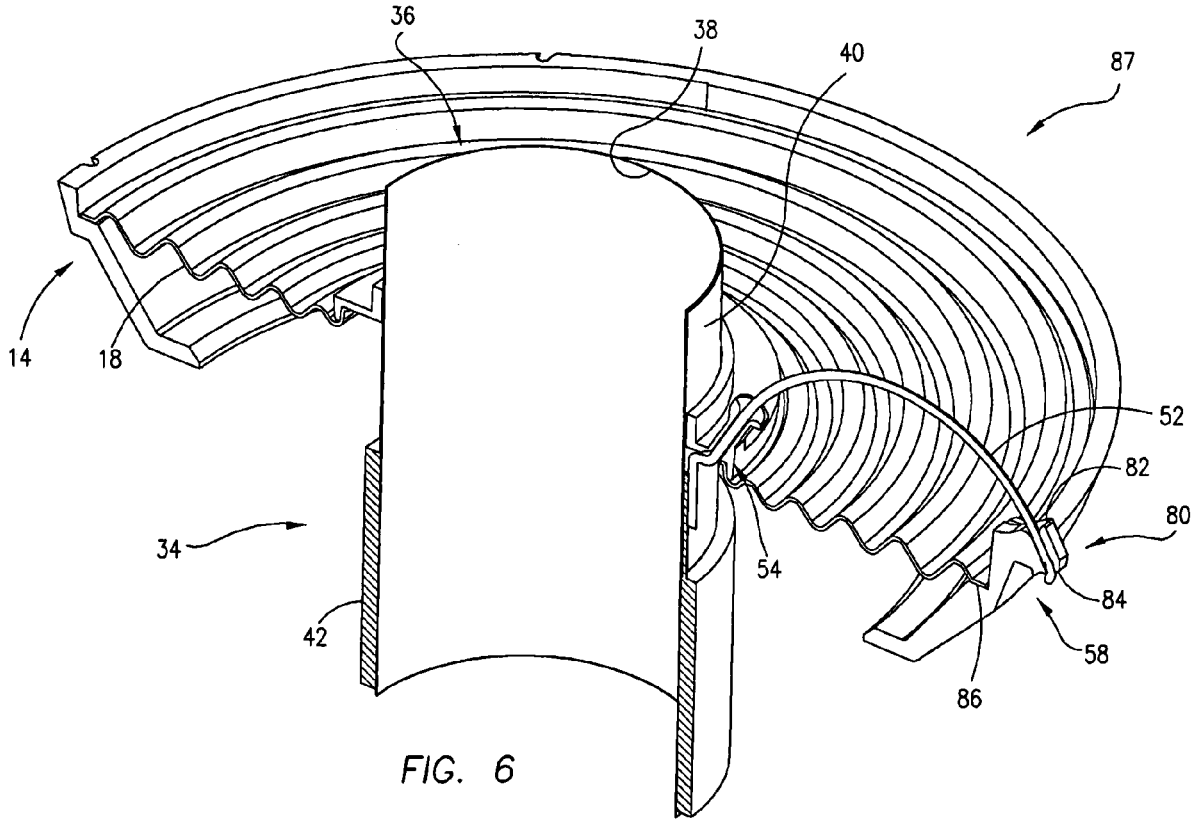
FIG. 6 is an isometric cross section of the spider subassembly shown in FIG. 4 illustrating the frame bracket in more detail.

In the embodiment of FIGS. 4 through 6, a voice coil bracket 54 is provided which is formed with a flange 56 shaped to rest against the outer surface 40 of the voice coil former 36. A frame bracket 58 is also provided, having a foot 60 mounted to a plateau 62 formed in the frame 14, or, alternatively, integrally formed with the frame 14. Although only one voice coil bracket 54 and one frame bracket 58 are shown in FIGS. 4-6, it should be understood that there is one voice coil bracket 54 and one frame bracket 58 for each of the typically two lead wires 52 employed in most speakers. Alternatively, each of the voice coil bracket 54 and frame bracket 58 could be formed as a single unit with two guides having the same configuration described below.

The voice coil bracket 54 includes a guide 64 in the form of a bore having an inlet end 68 and an outlet end 70 with a smooth, generally rounded edge. The guide 64 is angled toward the frame bracket 58, for purposes to become apparent below. An upper seat 74 is formed in the voice coil bracket 54 adjacent to the flange 56, and a lower seat 76 is formed at the base of the voice coil bracket 54 near the inlet end 68 of the guide 64. Using appropriate fixtures (not shown), the lower end of the diaphragm 16 is glued within the upper seat 74, and the inner diameter of the spider 18 is glued to the lower seat 76. Additionally, the flange 56 of the voice coil bracket 54 is glued to the former 36 at a location, in this embodiment, which is above the voice coil lead 78 extending from the wire winding 42.

The frame bracket 58 is formed with a guide 80 at its upper end in the form of a bore having a rounded inlet end 82 and an outlet end 84. The guide 80 is angled in a direction toward the voice coil bracket 54. A seat 86 is formed in the frame bracket 58, between the guide 80 and foot 60, which receives and mounts the outer diameter of the spider 18.

To simplify and speed up the speaker manufacturing operation, the voice coil 34, voice coil bracket 54, frame bracket 58 and spider 18 may be assembled as a unit or spider subassembly 87 outside of the frame 14. See FIG. 6. Initially, the voice coil bracket 54 is mounted to the outer surface 40 of the former 36 in the position shown in FIG. 5. The lead wire 52 is connected to the voice coil lead 78 from the wire winding 42. With the voice coil bracket 54 in place on the former 36, the lead wire 52 is inserted through the guide 64 in the voice coil bracket 54. Once the voice coil bracket 54 is mounted to the voice coil 34, the inner diameter of the spider 18 is connected to the voice coil bracket 54 by gluing it to the lower seat 76, and its outer diameter is glued to the seat 86 in the frame bracket 58. The opposite end of the lead wire 52 may be inserted into the guide 80 of the frame bracket 58 after the spider 18 is in place. The entire spider subassembly 87 is then mounted to the speaker 10 by sliding the voice coil 34 over the pole piece 28 of the motor structure 12 until the foot 60 of the frame bracket 58 contacts the plateau 62 in the frame 14 where it is glued in place. The end of the lead wire 52 carried by the frame bracket 58 is then connected by soldering, clamping or the like to electrical connectors (not shown) mounted to the frame 14. Finally, the lower end of the diaphragm 16 is slid over the voice coil former 36 until it engages the upper seat 74 of the voice coil bracket 54. The surround 20, which is connected to the diaphragm 16 at the factory, contacts the upper end 44 of the frame 14. Both the diaphragm 16 and surround 20 are glued in place thus securing the entire moving assembly to the frame 14.

As noted above, the lead wire 52 is preferably inserted through the guide 64 in the voice coil bracket 54 and through the guide 80 in the frame bracket 58 outside of the frame 14. In the embodiment of FIGS. 4-6, the guides 64 and 80 of the voice coil bracket 54 and frame bracket 58, respectively, are angled to cause the lead wire 52 to extend in an arc between the voice coil 34 and frame 14. The angles of the guides 64 and 80, and therefore the arc of the lead wire, are chosen to ensure that the lead wire 52 may readily move with the excursion of the voice coil 34 without stressing the connections of the lead wire 52 at either end or tending to pull the voice coil 34 in a side-to-side motion in the course of its movement within the magnetic gap 32. Relief of stress on the lead wire 52 connections is also provided by the rounded edge of the outlet 70 of guide 64, and the rounded inlet end 82 of the frame guide 58. Additionally, the particular arc of the lead wire 52 is chosen to avoid contact of the lead wire 52 with the diaphragm 16 or spider 18, and such arc can be altered depending on the size of the speaker 10 and the angle at which the diaphragm 16 extends between the surround 20 and voice coil 34. Accordingly, the voice coil bracket 54 and the frame bracket 58 allow for precise control of the lead wire 52 arc and length, thus eliminating the guesswork and inconsistencies which plagued prior art speakers. Further, because many of the assembly operations can be performed outside of the frame 14, the overall speaker assembly is greatly simplified and can be performed more quickly.

Figure 8:
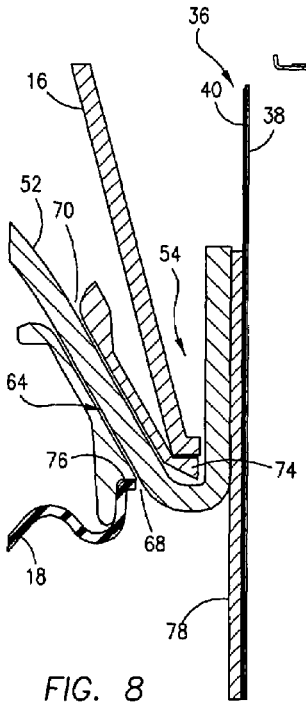
FIG. 8 is an enlarged view of the encircled portion of FIG. 7.
Figure 7:
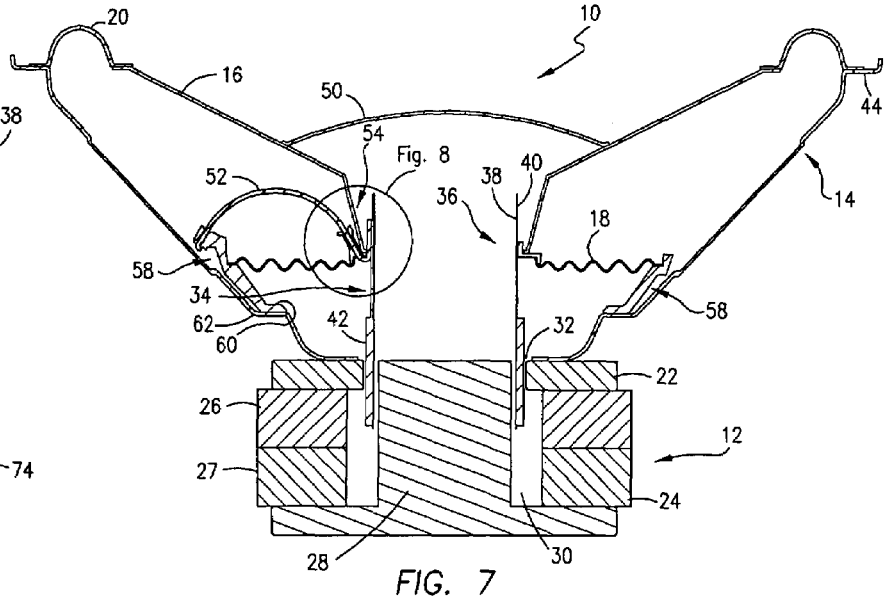
FIG. 7 is a view similar to FIG. 4 except with the lead wire mounted to the voice coil at a location above the guide in the voice coil bracket.
Figure 9:
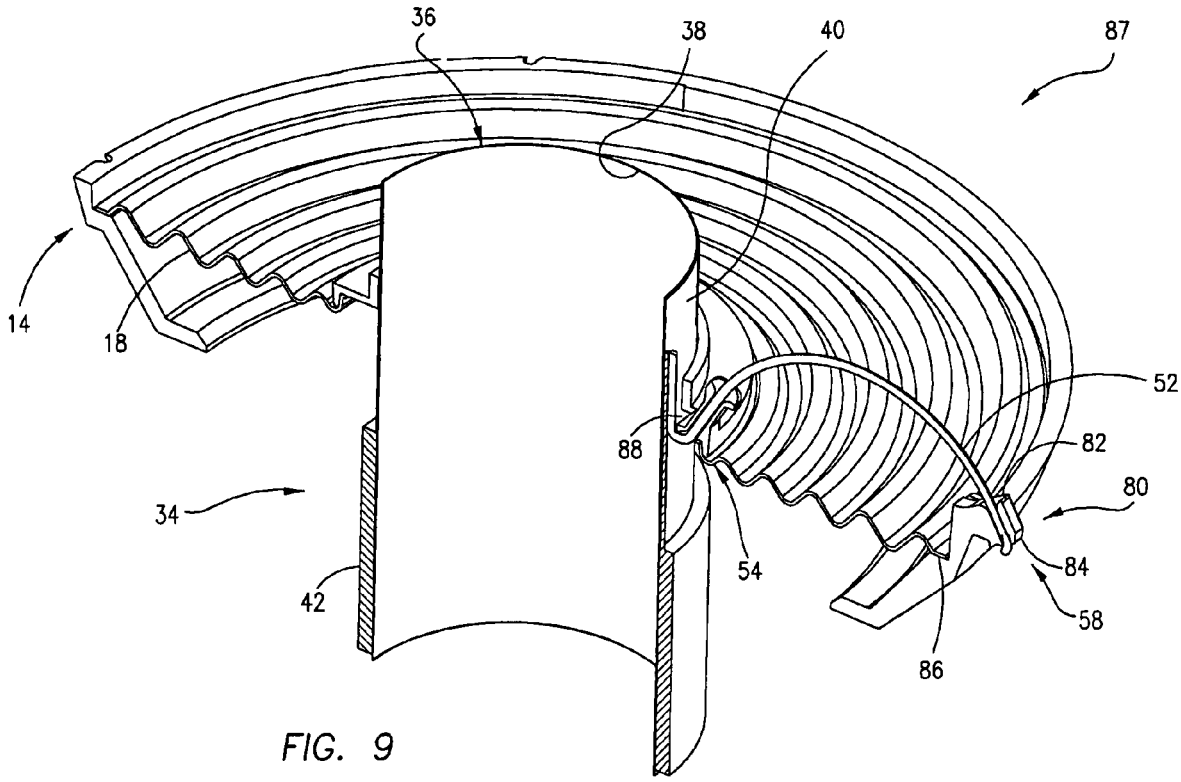
FIG. 9 is an isometric cross section of the spider subassembly shown in FIG. 7.

Referring now to FIGS. 7-13, alternative embodiments of the invention are shown which are similar in structure and operation to that discussed above in connection with FIGS. 4-6. In FIGS. 7-9, the same voice coil bracket 54 and frame bracket 58 are employed as in FIGS. 4-6, and they operate in the same manner as described above. The difference in this embodiment is that the voice coil bracket 54 is mounted to the voice coil former 36 in a position below the location where the lead wire 52 is connected to the voice coil lead 78. In order to insert the lead wire 52 into the guide 64, the voice coil bracket 54 is formed with a notch 88 as best seen in FIG. 9.

Figures 10, 11:
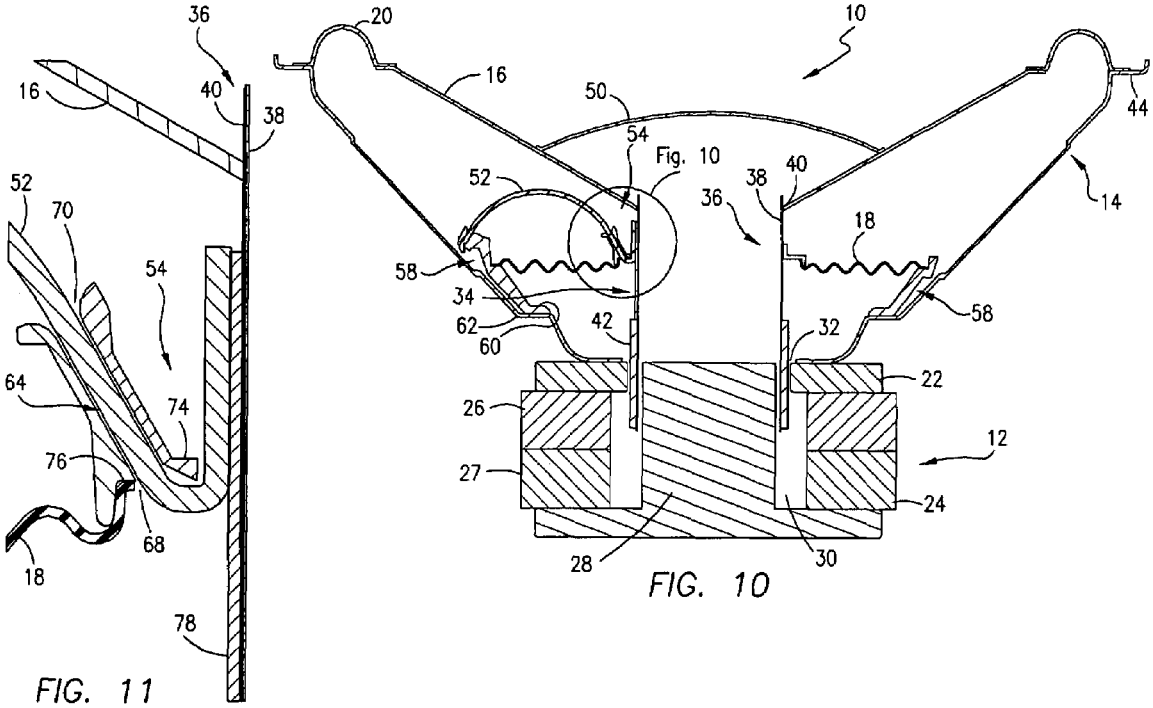
FIG. 10 is a view similar to FIG. 7 except with the diaphragm mounted directly to the voice coil instead of to an upper seat formed in the voice coil bracket.
FIG. 11 is an enlarged view of the encircled portion of FIG. 10.
Figures 12, 13:
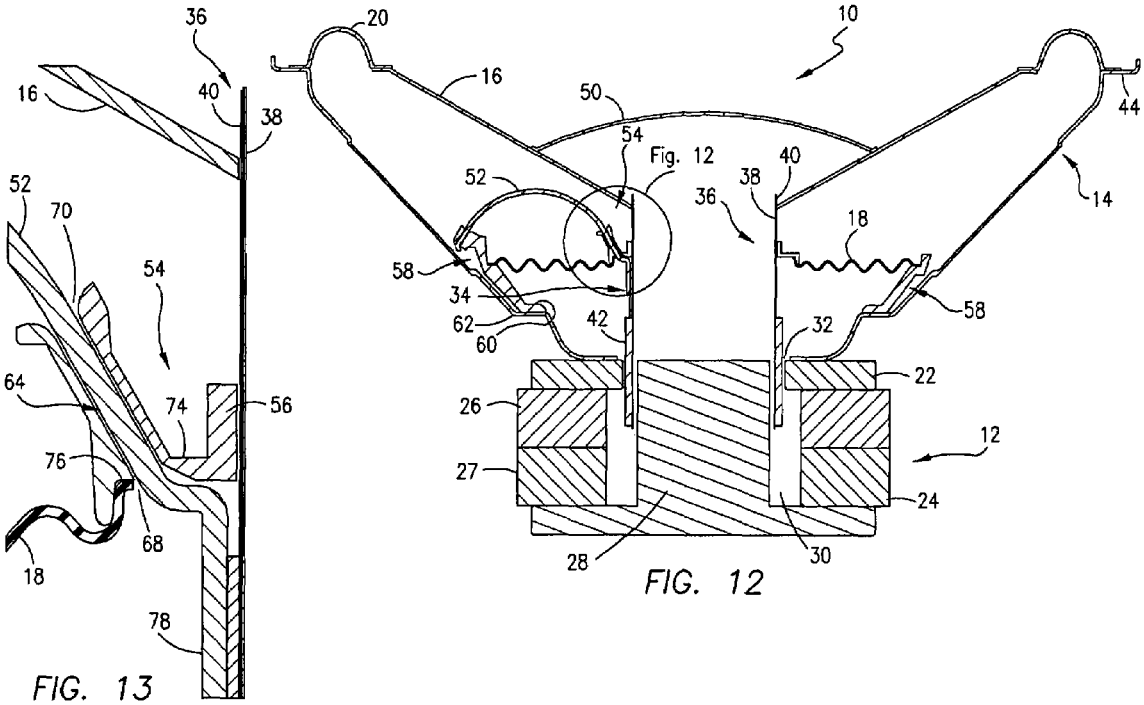
FIG. 12 is a view similar to FIG. 4 except with the diaphragm mounted directly to the voice coil instead of to a seat formed in the voice coil bracket.
FIG. 13 is an enlarged view of the encircled portion of FIG. 12.
Figure 14:
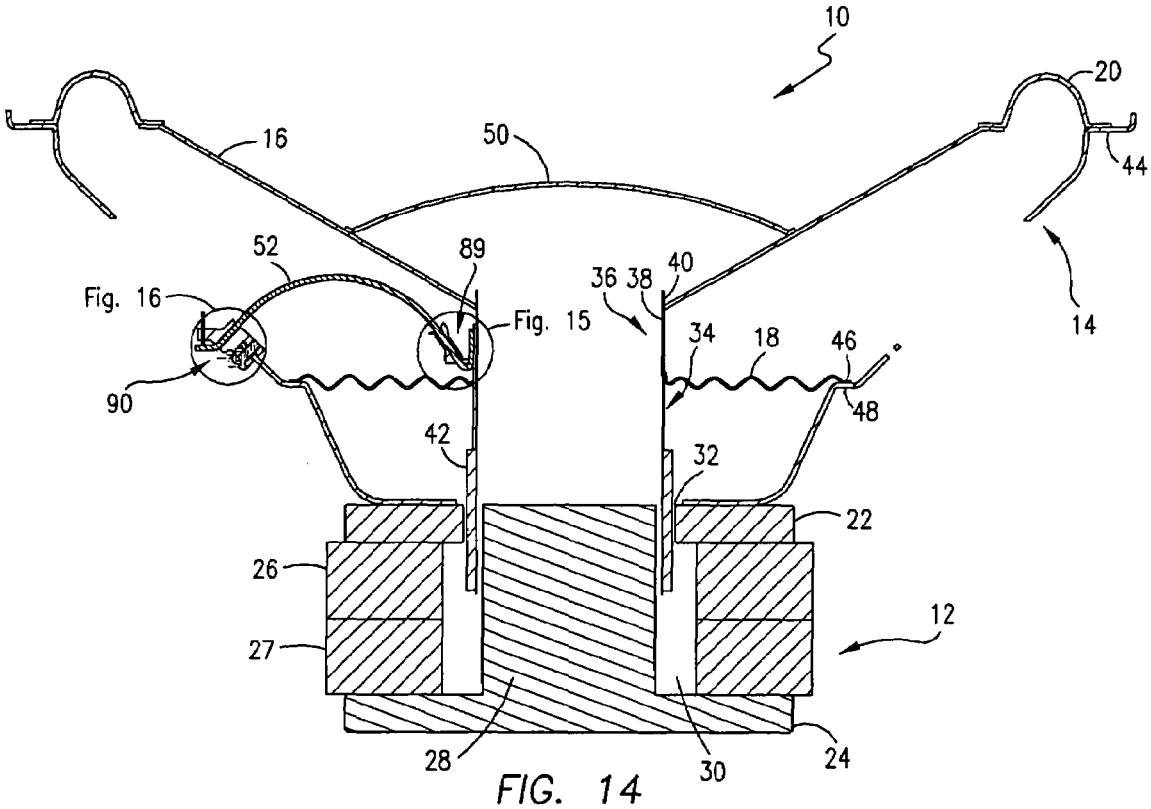
FIG. 14 is a cross sectional view of a loudspeaker depicting the voice coil bracket and frame bracket of this invention with both the diaphragm and the spider mounted directly to the voice coil.
Figure 15:
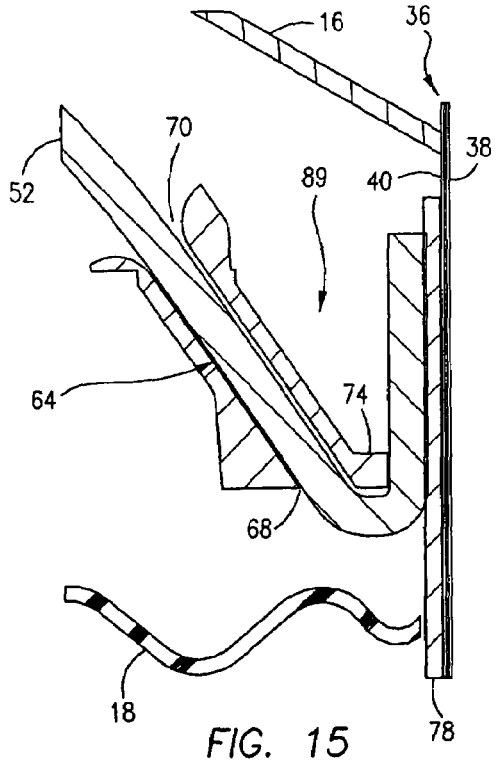
FIG. 15 is an enlarged view of one encircled portion of FIG. 14 showing the voice coil bracket.
Figure 16:
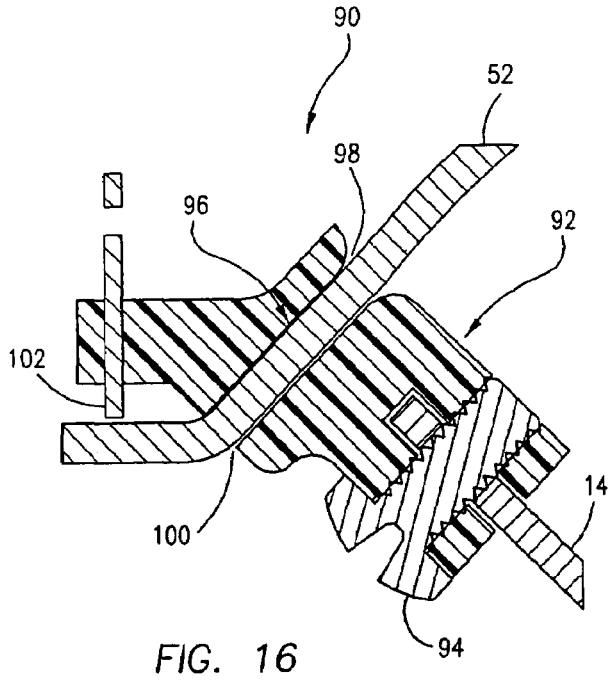
FIG. 16 is an enlarged view of another encircled portion of FIG. 14 illustrating the frame bracket.
Figure 17:
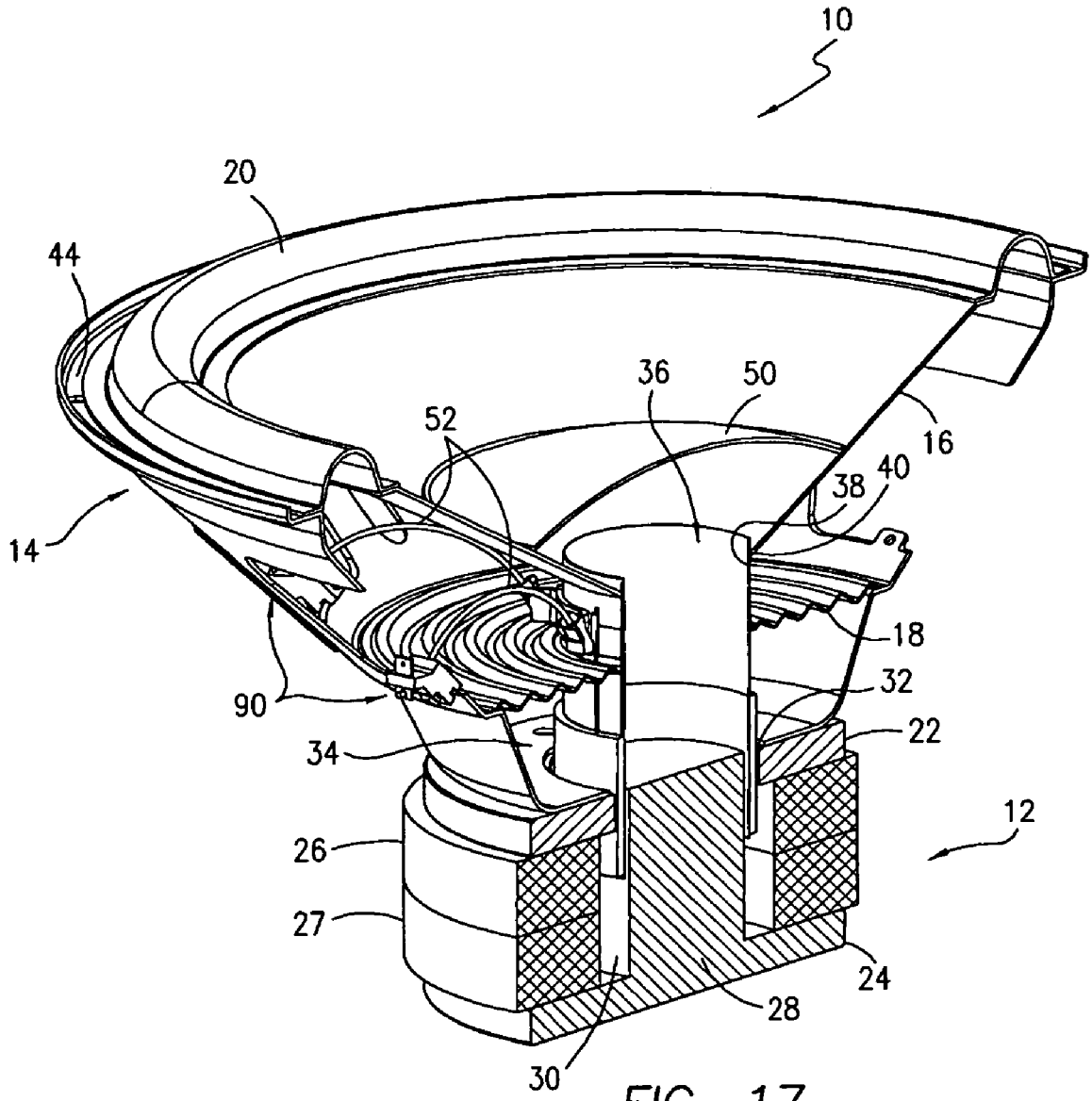
FIG. 17 is an isometric cross section of the speaker of FIG. 14.
Figure 18:
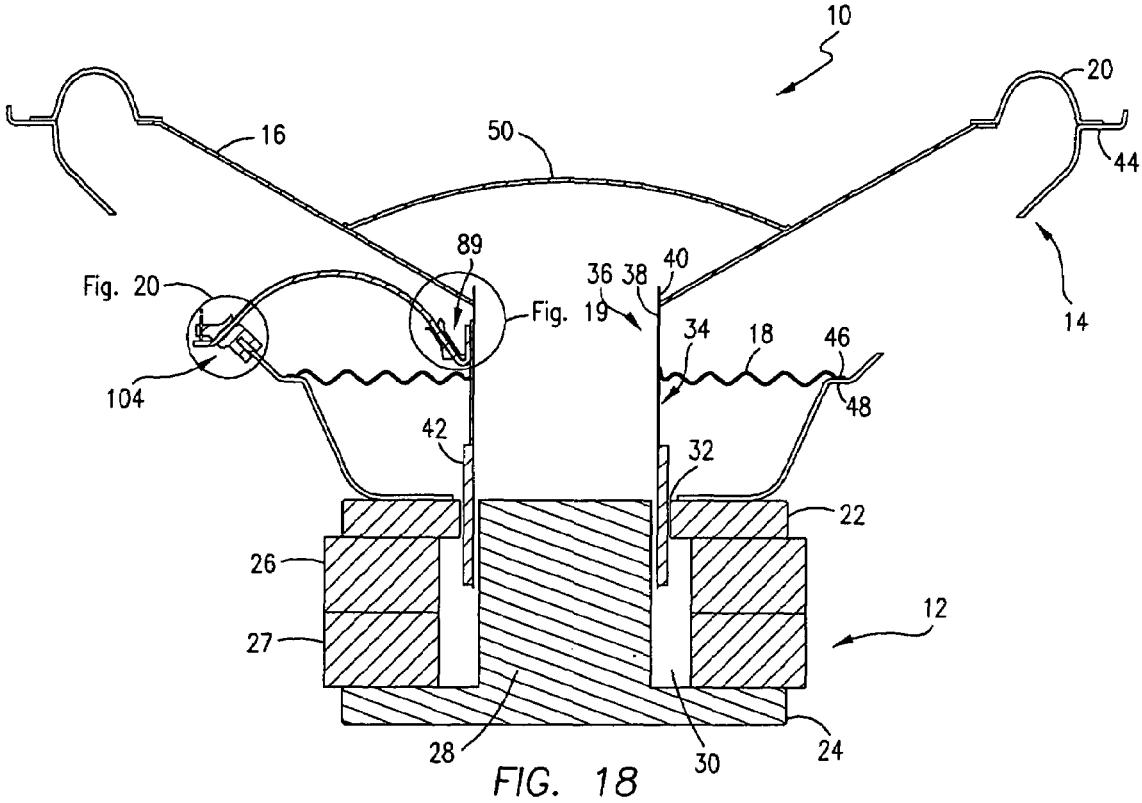
FIG. 18 is a cross sectional view of a loudspeaker depicting the voice coil bracket and frame bracket of this invention with both the diaphragm and the spider mounted directly to the voice coil.
Figure 19:
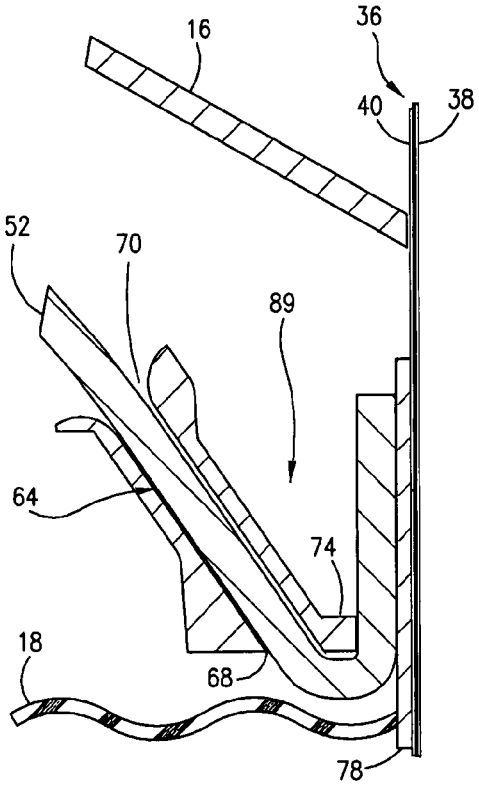
FIG. 19 is an enlarged view of one encircled portion of FIG. 18 showing the voice coil bracket.
Figure 20:
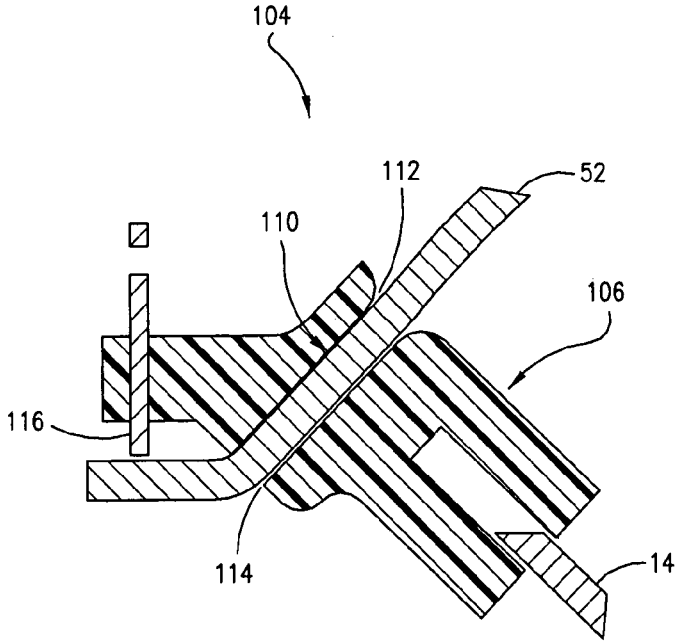
FIG. 20 is an enlarged view of another encircled portion of FIG. 18 illustration the frame bracket.
Figure 21:
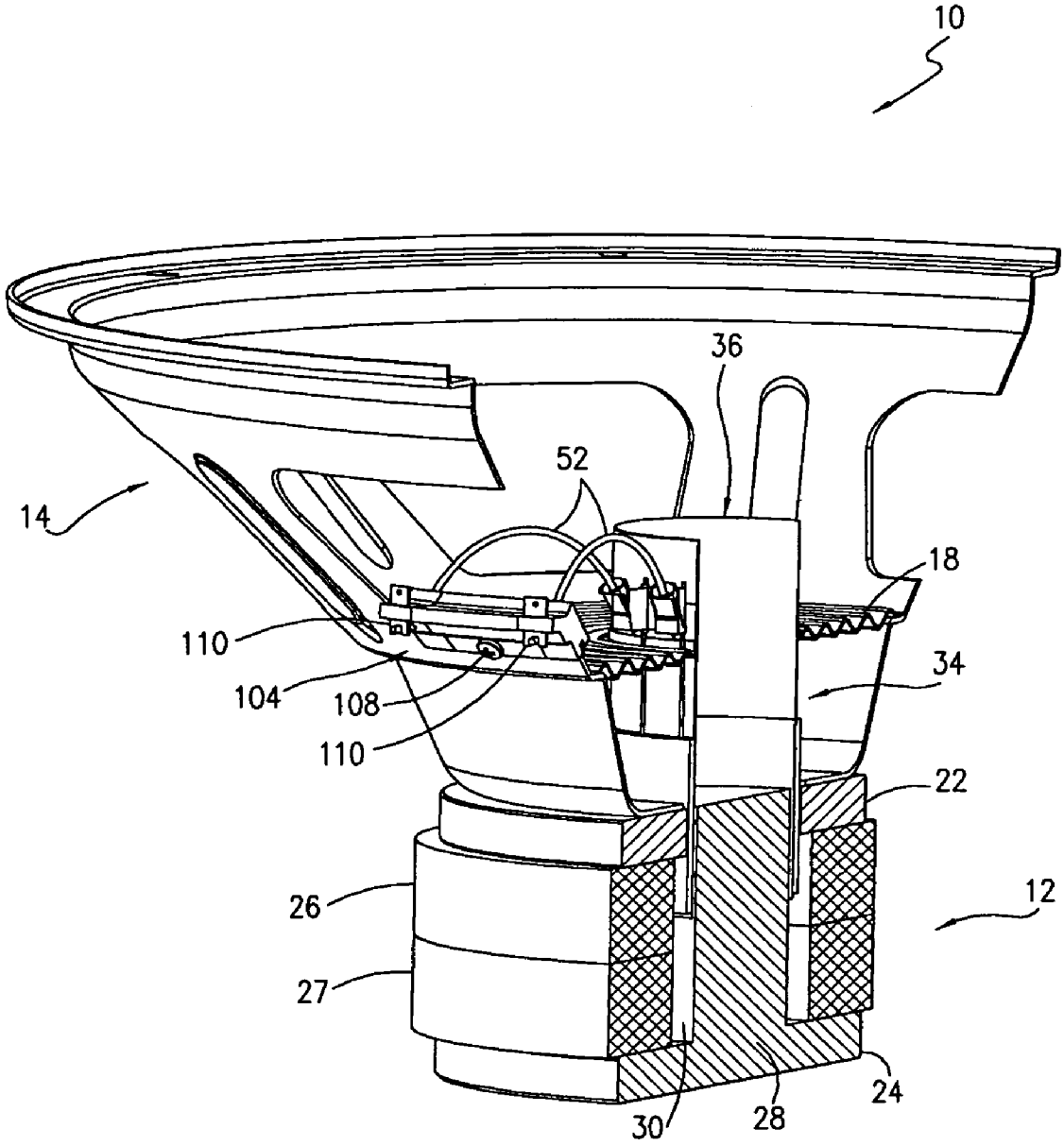
FIG. 21 is an isometric cross section of the speaker of FIG. 18.

The embodiment depicted in FIGS. 10 and 11 is the same as that shown in FIGS. 7-9, except that the lower edge of the diaphragm 16 is mounted directly to the former 36 of the voice coil 34 instead of to the upper seat 74 formed in the voice coil bracket 54. Similarly, the embodiment depicted in FIGS. 12 and 13 is the same as that shown in FIGS. 4-6, except, as in FIGS. 10 and 11, the lower edge of the diaphragm 16 is mounted directly to the former 36 of the voice coil 34 instead of to the upper seat 74 formed in the voice coil bracket 54.

Referring now to FIGS. 14-17, a further embodiment of the speaker 10 is shown. In this embodiment, a voice coil bracket 89 is employed which is similar to the voice coil bracket 54 described in the previous embodiments except the lower seat 76 is eliminated and the voice coil bracket 89 is formed in an arc segment a ring which extends completely around the former 36 as in the voice coil bracket 54. Each lead wire 52 is secured within the guide 64 of the bracket 89, as in FIGS. 7-11, but the diaphragm 16 is mounted directly to the voice coil former 36 at a location above the bracket 89 and the inner diameter of the spider 18 is mounted to the former 36 below the bracket 89. The outer diameter of the spider 18 is mounted to the frame plateau 48.

Different frame brackets 90 are provided in the embodiment of FIGS. 14-17 since the spider 18 is mounted to the plateau 48. Each frame bracket 90 has a yoke 92 formed with at least one bore. The yoke 92 fits over an edge of the frame 14 so that its bore aligns with a bore in the frame 14. These bores receive a screw 94 which secures the bracket 90 to the frame 14. The upper portion of the frame bracket 90 has a guide 96 formed with a rounded, inlet end 98 and an outlet end 100. One lead wire 52 is extended through the guide 96 of each frame bracket 90 so that its end is positioned to engage an electrical contact 102 carried by the frame bracket 90.

The voice coil brackets 89 and frame brackets 90 perform the same functions in controlling the arc and length of the lead wires 52 as described above in connection with a discussion of FIGS. 4-7. The guides 64 and 96 are angled so that the arc of the lead wires 52 allows for free movement of the voice coil 34 without creating contact between the diaphragm 16 or spider 18 and the lead wires 52.

Referring now to FIGS. 18-21, a still further embodiment of this invention is illustrated which is similar to that of FIGS. 14-17 except in the construction of the frame bracket 104. Instead of two separate frame brackets 90, as employed in the embodiment of FIGS. 14-17, the frame bracket 104 depicted in FIGS. 18-21 is a single unit having a yoke 106 which fits over the frame 14 so that aligning bores in the bracket 104 and frame 14 can receive a screw 108 to mount the two elements together. The bracket 104 has spaced guides 110, each having a rounded inlet end 112 and an outlet end 114, which receive one of the lead wires 52. The end of each lead wire 52 is located in position to engage an electrical contact 116 carried by the bracket 104. The embodiment of FIGS. 18-21 is otherwise the same as in FIGS. 14-17, and operates in the same fashion.

While the invention has been described with reference to a preferred embodiment, it should be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A loudspeaker, comprising:

a motor structure including a movable voice coil having a former wrapped with a wire winding;

a frame;

an upper suspension connected to said frame;

a diaphragm coupled to said upper suspension and to said voice coil;

a lower suspension coupled to said frame and to said voice coil;

a first bracket coupled to said former of said voice coil, said first bracket having a first guide for supporting a first end of a lead wire which is coupled to said wire winding;

a second bracket coupled to said frame, said second bracket having a second guide for supporting a second end of said lead wire;

said first guide and said second guide being oriented at an angle relative to one another so as to create an arc in said lead wire extending between said voice coil and said frame whereby said lead wire is substantially prevented from contacting said diaphragm or said lower suspension and from interfering with the movement of said voice coil.

2. The loudspeaker of claim 1 in which said first guide is a bore formed in said first bracket, said lead wire being extended through said bore so that said first end thereof is carried by said first bracket.

3. The loudspeaker of claim 1 in which said first bracket is formed with a first seat, said lower suspension having an inner diameter and an outer diameter, said lower suspension being mounted along said inner diameter thereof to said first seat.

4. The loudspeaker of claim 1 in which said first bracket is formed with a second seat, said diaphragm having an inner end which is mounted to said second seat.

5. The loudspeaker of claim 1 in which said second guide is a bore formed in said second bracket, said lead wire being extended into said bore so that said second end thereof is carried by said second bracket.

6. The loudspeaker of claim 1 in which said diaphragm is coupled to said voice coil at a first location and said lower suspension is coupled to said voice coil at a second location, said first bracket being coupled to said former of said voice coil in between said first and second locations.

7. The loudspeaker of claim 1 in which said second bracket is formed with a yoke which receives said frame, said yoke and frame being interconnected by at least one fastener.

8. The loudspeaker of claim 1 in which said first bracket is formed with a notch to permit said lead wire to be inserted within said guide.

9. The loudspeaker of claim 1 in which said first guide is formed with an outlet end having a rounded edge.

10. The loudspeaker of claim 1 in which said second guide is formed with an inlet end having a rounded edge.

11. The loudspeaker of claim 1 in which said second bracket is formed with a foot and said frame is formed with a plateau, said foot of said second bracket being mounted to said plateau of said frame.

12. The loudspeaker of claim 1 in which said second bracket is formed with a seat, said lower suspension having an outer diameter which is mounted to said seat of said second bracket.

13. A loudspeaker, comprising:

a motor structure including a movable voice coil having a former wrapped with a wire winding;

a frame;

an upper suspension coupled to said frame;

a diaphragm having a first end coupled to said upper suspension and a second end;

a lower suspension having a first end coupled to said frame and a second end;

a voice coil bracket coupled to said former of said voice coil, said voice coil bracket having an upper seat, a lower seat and a first guide, said first guide supporting a first end of a lead wire which is coupled to said wire winding, said second end of said diaphragm being mounted to said upper seat, said second end of said lower suspension being mounted to said lower seat;

a frame bracket coupled to said frame, said frame bracket having a second guide for supporting a second end of said lead wire.

14. The loudspeaker of claim 13 in which said first guide is oriented at an angle in the direction of said second guide.

15. The loudspeaker of claim 14 in which said second guide is oriented at an angle in the direction of said first guide.

16. The loudspeaker of claim 15 in which said angle of said first guide and said angle of said second guide are chosen to create an arc in said lead wire extending between said voice coil and said frame so that said lead wire does not contact said diaphragm or said lower suspension and does not interfere with the movement of said voice coil.

17. The loudspeaker of claim 13 in which said first guide is formed with an outlet end having a rounded edge.

18. The loudspeaker of claim 13 in which said second guide is formed with an inlet end having a rounded edge.

19. The loudspeaker of claim 13 in which said frame bracket is formed with a foot and said frame is formed with a plateau, said foot of said frame bracket being mounted to said plateau of said frame.

20. The loudspeaker of claim 13 in which said frame bracket is formed with a seat, said lower suspension having an outer diameter which is mounted to said seat of said frame bracket.

21. The loudspeaker of claim 13 in which said frame bracket includes an electrical contact positioned to engage said second end of said lead wire.

* * * * *